United States Patent [19]

Durach et al.

[11] Patent Number: 4,758,140

[45] Date of Patent: Jul. 19, 1988

[54] ROTARY PISTON BLOWER HAVING OFFSET SHAFTS AND A TAPERED HOUSING TO COMPENSATE FOR THERMAL DEFORMATION

[75] Inventors: Wilhelm Durach, Lindau; Wolfgang Sohler, Wangen; Werner Schubert, Lindau, all of Fed. Rep. of Germany

[73] Assignee: Wankel GmbH, Berlin, Fed. Rep. of Germany

[21] Appl. No.: 64,848

[22] Filed: Jun. 19, 1987

[30] Foreign Application Priority Data

Jun. 25, 1986 [DE] Fed. Rep. of Germany ..... 3621176

[51] Int. Cl.[4] ..... F04C 29/04; F04C 18/18

[52] U.S. Cl. ..... 418/83; 418/206

[58] Field of Search ..... 418/83, 101, 205, 206

[56] References Cited

U.S. PATENT DOCUMENTS 2,014,932 9/1935 Hallet ..... 418/83
4,089,625 4/1978 Hofmann, Jr. ..... 418/83
4,511,316 4/1985 Ellis ..... 418/206

FOREIGN PATENT DOCUMENTS 0093983 5/1984 Japan ..... 418/83

*Primary Examiner*—John J. Vrablik
*Assistant Examiner*—Leonard P. Walnoha
*Attorney, Agent, or Firm*—Becker & Becker

[57] ABSTRACT

An external axial rotary piston blower having a housing including a casing part and two side parts of which the casing part encompasses a cylindrical runway surfacing which is formed by two cylinders intersecting each other in a region of an inlet and an outlet and in which two identical pistons having at least one wing portion rotate among each other, such pistons having starting surfaces with a large radius running against a casing runway surfacing and respectively another piston having a starting surface with a small radius running correspondingly against a casing runway surfacing. Shafts of the pistons are offset or shifted in cold condition in a direction of a short housing axis toward the outlet and the housing on the side of the outlet is shorter in axial direction in cold condition than on the side of the inlet.

3 Claims, 1 Drawing Sheet

ROTARY PISTON BLOWER HAVING OFFSET SHAFTS AND A TAPERED HOUSING TO COMPENSATE FOR THERMAL DEFORMATION

BACKGROUND OF THE INVENTION

1. Field of the Invention

The present invention relates to an external axial rotary piston blower with a housing consisting of a casing or mantle part and two side parts. The casing or mantle part encompasses inner cylindrical surfaces or raceway means formed out of two cylinders intersecting each other in a region of an inlet and outlet communicating with internal chamber means in which two identical single-wing respectively dual-wing piston means rotate, which have approach or starting surfaces with large radius along the casing raceway means and having approach or starting surfaces with small radius engaging respectively with the other piston.

2. Description of the Prior Art

Such blowers of half-roller or quarter-roller type of construction are employed and utilized preferably as superchargers, blowers or compressors for internal combustion engines. The compression or compacting of the operating medium arising hereby is adequate to bring about a heat expansion of the housing on the pressure side thereof, while the suction side of the housing is cooled by the nearly uninterrupted flow of cold operating medium coming thereto and consequently not experiencing or suffering any heat distortions or warpage. The same is true for pistons of which approach or starting surfaces with large radius constantly come into engagement with cold operating medium. Thereby an expanding of the housing results in operation on a pressure side of the housing both in radial direction as well as an axial direction, while the piston means in a very much more nominal extent or measure are subject to such heat expansions. For this reason, just upon the pressure side particularly there result gaps that are too wide between the casing raceway surfacing and approach or starting surfaces of the piston with large radius on the one hand and between the side walls of the piston and the side walls of the housing upon the pressure sides thereof on the other hand. Since the housing preferably consists of aluminum, these heat expansions have greater meaning attributable thereto. The heat expansions at higher speeds and pressures lead to supply or delivery losses and capacity or efficiency losses, which under all circumstances should be avoided.

SUMMARY OF THE INVENTION

An object of the present invention consequently is to avoid these gap losses arising via heat expansion. The object of the present invention is resolved and fulfilled with the blowers under consideration via features of the present invention described subsequently herein in further detail.

BRIEF DESCRIPTION OF THE DRAWING

This object, and other objects and advantages of the present invention, will appear more clearly from the following specification in conjunction with the accompanying drawing.

DESCRIPTION OF PREFERRED EMBODIMENTS

Figure 1:
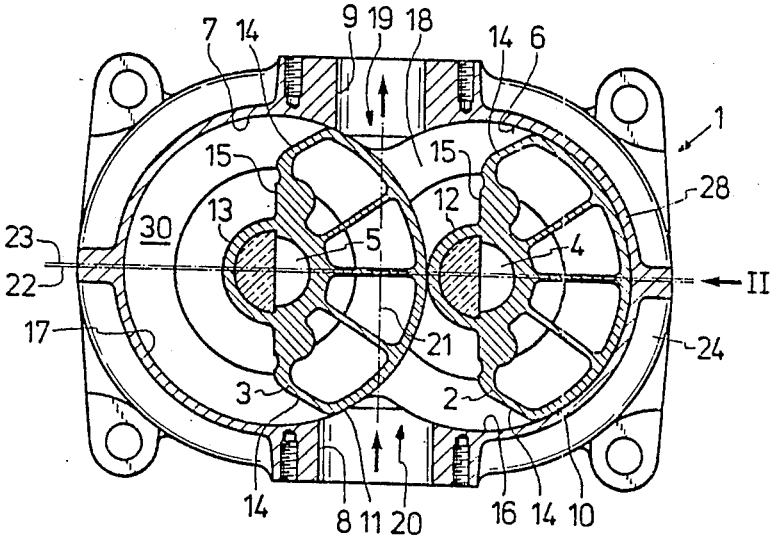
FIG. 1 is a view that shows a radial section taken along line I—I in FIG. 2 showing a half-roller blower having features in accordance with the present invention.

Referring now to FIG. 1 of the drawing, this illustrates a radial section of a blower of the semi- or half-roller type of construction, although the features of the present invention can be employed and considered applicable in the same manner for quarter-roller blowers, whereby only the pistons need to be exchanged. FIG. 1 shows a housing 1 with pistons 2 and 3 respectively which rotate on shafts 4 and 5 respectively. The dual-arc housing 1 has two cylinder-shaped walls 6 and 7 which intersect in the region of an inlet 8 and an outlet 9 and together form the mantle or casing runway surfacing. The pistons 2 and 3 with cylinder surfaces 10 and 11 with large radius run along the raceway surfacing. The pistons 2 and 3 have further cylinder surfaces 12 and 13 with small radius and between these and the cylinder surfaces with large radius respectively each have two engagement or meshing surfaces 14 and 15.

The working or operating medium conveyed in the working or operating chamber 16 and 17 warms or heats up in chamber 18 before the outlet, so that the housing 1 on the pressure side 19 thereof is subjected to a heat expansion, while a suction side 20 of the housing 1 cooled continuously by entering working or operating medium experiences no expansion in operation. In order to avoid that too large gaps open on the pressure side as a consequence of the heat expansion between the cylinder surfaces 4 and 5 of the casing runway surfacing and the cylinder surfaces 10 and 11 with large radius of the pistons 2 and 3, the shafts are arranged offset or displaced in direction toward the outlet by an amount which corresponds to the heat expansion of the housing in radial direction upon the pressure side and moreover being shifted or offset in a direction parallel to a short housing axis 21. This shift or offset occurs by the distance or spacing of a line 22 from a line 23 in FIG. 1, whereby in reality the measure or distance of this offset or shifting with a conventional housing lies in a range of 0.03 to 0.05 mm.

Figure 2:
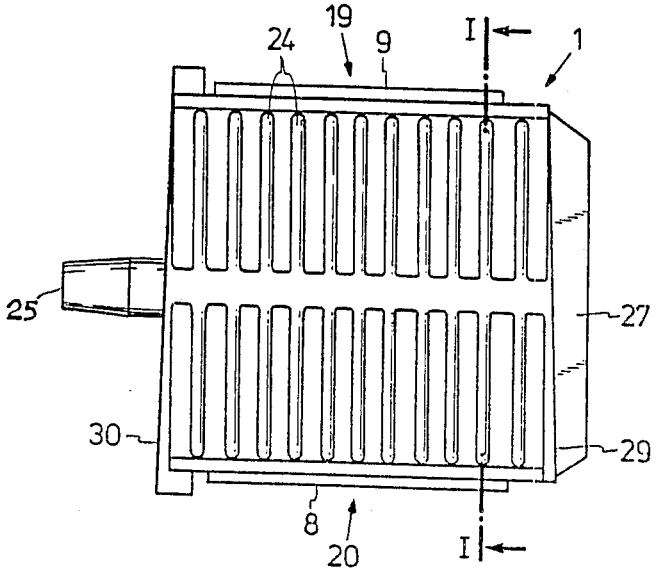
FIG. 2 is a plan view of the same blower taken in a direction of arrow II in FIG. 1.

FIG. 2 is a plan view from above upon the blower illustrated in section in FIG. 1, whereby cooling ribs 24, drive journals or driver projections 25 of the shaft 5, and a housing cover 27 for the transmission chamber are illustrated in this view. The housing is wider on the suction side 20 than on the pressure side 19 and moreover by an amount of heat expansion of the casing part 28 in operation. The side walls 29 and 30 are set or placed correspondingly at an incline, whereby the illustration of FIG. 1 shows the angle or degree of adjustment thereof shown larger for purposes of clearness, so that the housing in horizontal section has a trapezoidal-shaped outline or configuration. The side length of the housing 1 on the suction side 20 in the height or level of the inlet 8 with conventional size of such blowers is in a range between 0.06 to 0.1 mm longer than the side length on the pressure side 19 in the higher level of the outlet 9.

The side walls in operation become parallel as a consequence of the heat expansion of the pressure side 19 as also a normal small as possible gap is maintained between the cylindrical approach or starting surfaces of the pistons along the casing raceway surfacing. The offset or shift of the shafts and the slanted or inclined positioning of the side walls however cannot be permitted to go so far that the pistons in cold condition can engage or run against the housing walls.

The present invention is, of course, in no way restricted to the specific disclosure of the specification and drawing, but also encompasses any modifications within the scope of the appended claims.

What we claim is:

1. An external axial rotary piston blower having sides as well as an inlet and an outlet with a housing including a short housing axis between the inlet and outlet as well as consisting of a casing part and two side parts of which the casing part encompasses a runway surfacing, which s formed of two cylinders intersecting each other in a region of the inlet and outlet, in which shafts and two identical pistons thereon having at least one wing portion each rotate among each other in said housing, said pistons including starting surfaces with large radius running along the casing runway surfacing and with starting surfaces having a smaller radius of the respectively other piston also running along the corresponding casing runway surfacing, comprising:

means that offset shafts of said pistons in cold condition in a direction of the short housing axis toward the outlet; and said housing on the side of the outlet in an axial direction being shorter in cold condition than that on the side of the inlet.

2. A rotary piston blower according to claim 1, wherein said shafts are offset by a range of 0.03 to 0.05 mm in a direction toward the outlet in cold condition.

3. A rotary piston blower according to claim 1, wherein said housing is shortened in cold condition on the side of the outlet by a range of 0.06 to 0.1 mm.

* * * * *